United States Patent [19]

Leth-Olson et al.

[11] Patent Number: 4,695,691

[45] Date of Patent: Sep. 22, 1987

[54] SWITCH HOUSING HAVING FIXED EXTERNAL NUTS FOR ATTACHMENT OF CONTACTS AND TERMINALS

[75] Inventors: Henrik Leth-Olson, Ringsted; Lajos K. D. Marot, Virum, both of Denmark

[73] Assignee: Aktieselskabet Laur.Knudsen Nordisk Elektricitets Selskab, Copenhagen, Denmark

[21] Appl. No.: 817,107

[22] Filed: Jan. 8, 1986

[30] Foreign Application Priority Data

Jan. 14, 1985 [DK] Denmark ..... 161/85

[51] Int. Cl.[4] ..... H01H 19/04

[52] U.S. Cl. ..... 200/303; 200/293; 174/52 R; 206/328; 220/4 E

[58] Field of Search ..... 200/293, 284, 303, 304, 200/307, 284, 243; 361/335, 357, 427, 417–419, 394, 393, 431; 174/50, 52 R, 61, 65 R, 59; 220/4 B, 4 R, 4 E, 4 C; 206/328

[56] References Cited

U.S. PATENT DOCUMENTS

| | | | |
|---|---|---|---|
| 2,418,831 | 4/1947 | Hamilton | 200/303 X |
| 3,194,899 | 7/1965 | Stock | 200/303 X |
| 3,510,729 | 5/1970 | Gryctko et al. | 361/357 X |
| 3,601,568 | 8/1971 | Sorenson | 200/303 X |
| 3,855,558 | 12/1974 | Hayward | 200/303 X |
| 4,027,096 | 5/1977 | Waddington et al. | 174/52 R |
| 4,204,248 | 5/1980 | Proffit et al. | 361/427 X |
| 4,356,368 | 10/1982 | Osika | 200/307 |
| 4,518,838 | 5/1985 | Werner | 200/303 |

FOREIGN PATENT DOCUMENTS

| | | | |
|---|---|---|---|
| 0093327 | 11/1983 | European Pat. Off. | 200/303 |
| 2833043 | 2/1979 | Fed. Rep. of Germany | 200/303 |

*Primary Examiner*—Stephen Marcus
*Assistant Examiner*—Ernest G. Cusick
*Attorney, Agent, or Firm*—Cushman, Darby & Cushman

[57] ABSTRACT

A switch housing includes two identical halves forming a top wall and a bottom wall each of which has transverse countersinks. The countersinks are provided with permanently secured polygonal nut members for receiving screws for fastening the mounting ends of L-shaped fixed contacts and external terminals. The countersinks also have elongated holes for receiving the contact ends of L-shaped contacts.

6 Claims, 16 Drawing Figures

SWITCH HOUSING HAVING FIXED EXTERNAL NUTS FOR ATTACHMENT OF CONTACTS AND TERMINALS

The invention relates to a switch housing for switches such as motor switches and load switches and comprising a top and a bottom member, fixed contacts or terminals for input and output current, movable contacts opening and closing current paths through said fixed contacts, a reciprocative contact bridge supporting said movable contacts, and a guiding mechanism for said contact bridge for switching on and off said movable contacts.

BACKGROUND OF THE INVENTION

In connection with the construction of industrial switchboards it was previously necessary to include various types of switches in order to meet varying requirements and fulfil various requirements as to loadability, breaking capacity, heat generation etc. The latter applies furthermore when an existing switchboard is to be extended.

Today substantially three different types of switches are employed, viz. conventional quick switches and fuse switches for AC23-operation (motor switches) and parallel switches for AC21 or AC22-operation (load switches). The designations and definitions used are in accordance with the IEC-standard 408.

The above three types of switches were previously delivered completely mounted from the contractors, and as it is impossible for a switchboard constructor to know in advance how many pieces he need of each type of switch (for new switchboards being ordered), it is obvious that great amounts of capital is bound in the stock of switches. In addition, the slightest change of a switch implies usually that the housing is dismounted and that the vital members of the switch are interfered with, i.e. the interior connections to fixed contact locations, the contact bridge, and the guiding mechanism thereof. A typical change is for instance that a fuse switch is altered into a conventional quick switch, or that a motor switch is altered into a load switch. Since such alterations are not allowed by other persons than the contractor partly on account of the safety and partly on account of the product responsibility and the conditions for the fulfilling of the guarantee, the switchboard constructors are thus forced partly to involve a great expensive stock and to put up with delays in case the order involves particular solutions

SUMMARY OF THE INVENTION

A switch housing of the above type is according to the invention characterised in that the top member and the bottom member are completely identically shaped, and that all the fixed contacts are mounted on polygonal nut parts or nut plates exposed at the outer surface of the housing and permanently mounted in said housing, said nut parts or nut plates establishing both a mechanical and an electric connection between the fixed contacts and replaceable external connecting means on the outside of the housing.

The above combination ensures a great flexibility when constructing new or reconstructing or extending existing switchboards because based on the switch housing as a basic unit it is possible to provide the exact type of switch necessary in the case in question merely by securing various copper parts on the fixed contact locations or terminals. Less skilled persons can also carry out the above because said mounting does not interfere with the (internal) vital members of the switch, the halves not having to be dismounted.

Furthermore it is an economical advantage that the stock of switches can be minimized as unlike previously it is no longer necessary to stock three different types of completely mounted switches, but merely a suitable number of switch housings according to the invention together with a suitable selection of external fitments such as various fuse holders, short-circuit rails, terminal extensions etc. If desired, the electrician can construct a short-circuit rail himself based on guidelines provided by the switch constructor in case an acute shortage thereof should arise. The basic unit can furthermore be delivered by the manufacturer at shorter notice than completely mounted switches for particular purposes.

BRIEF DESCRIPTION OF THE DRAWING

The invention will be described below with reference to the accompanying drawing, in which

FIG. 1 is a side view of one half of the switch housing generally designated 21. This half 21 is shaped in such a manner that it can serve both as a bottom member and a top member of the switch housing, which clearly appears from FIG. 2 showing a vertical, side view of the assembled switch housing.

DESCRIPTION OF PREFERRED EMBODIMENTS

Figure 1:
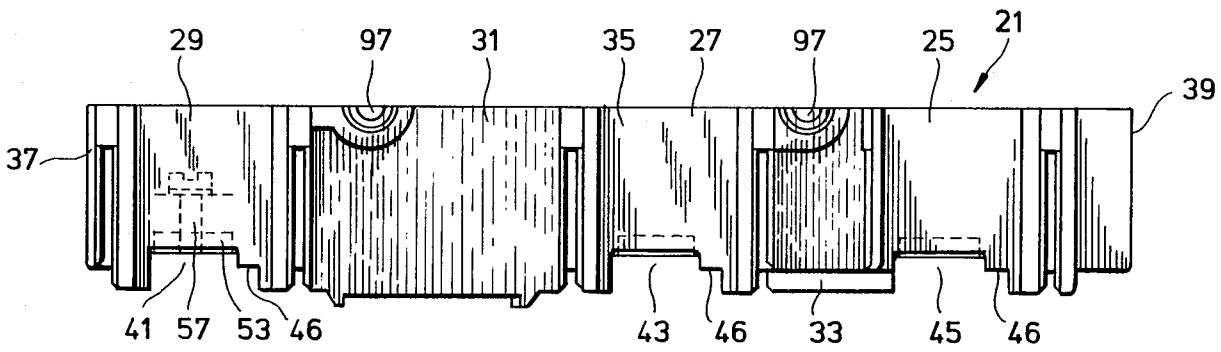
FIG. 1 is a vertical, side view of one half of the switch housing according to the invention.

A set of fixed contact locations for each of the three phases R, S, and T as well as a set of movable contacts are provided in the switch housing for switching on and off the phase currents. The movable contacts are positioned either in an IN-position or an OUT-position by means of a guiding mechanism not described in the following as it is irrelevant to the invention per se. The guiding mechanism has been described in details in U.S. patent application Ser. No. 789,123 filed Oct. 18, 1985 entitled "Electric switch". Only the handle shaft of this guiding mechanism has been shown, said handle shaft being designated 23 in FIGS. 2, 3, and 4.

The switch housing is divided into sections with a section 25, 27, and 29, respectively, for each of the three phase R, S, and T as well as a separate section 31 for the above guiding mechanism which is coupled between two of the phase sections.

Each half 21 of the switch housing is shaped substantially as an open box and comprises thus a bottom wall 33, two side walls 35 mirror-symmetrical about a central plane 34, as well as two almost identically shaped end walls 37 and 39.

Figure 3:
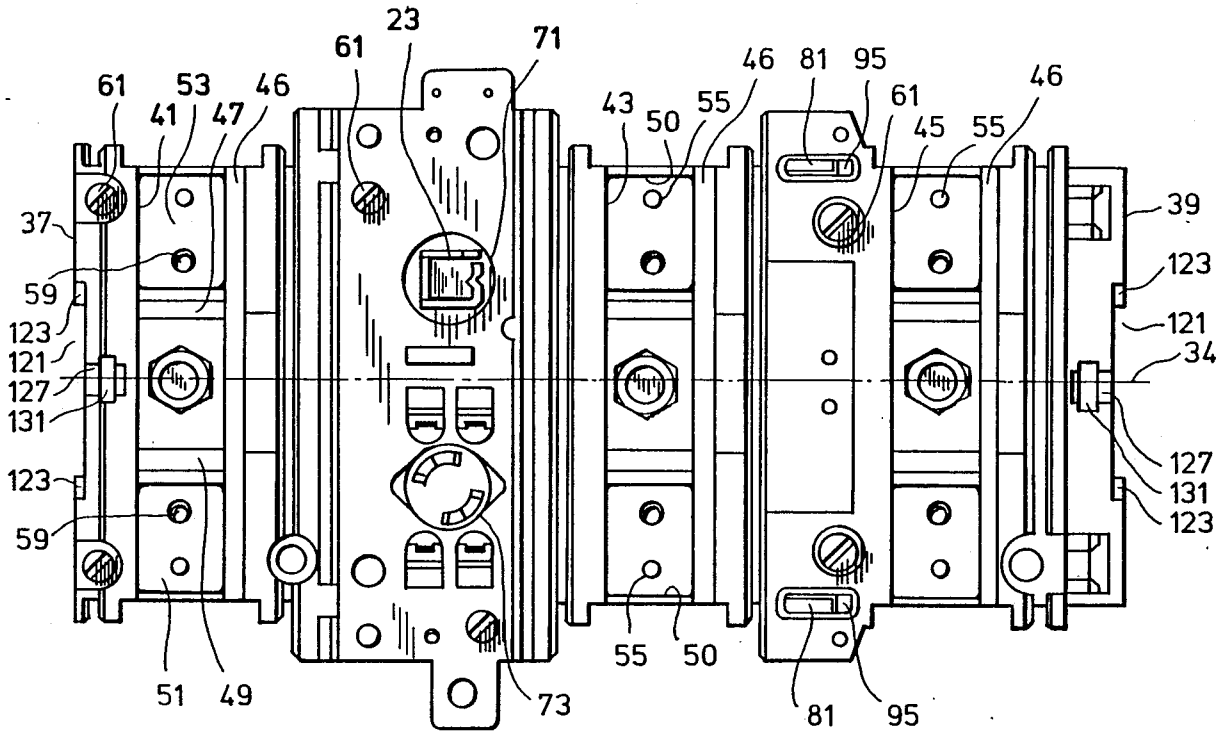
FIG. 3 is a horizontal, top view of the switch housing with a contact bridge and guiding mechanism mounted thereon.
Figure 4:
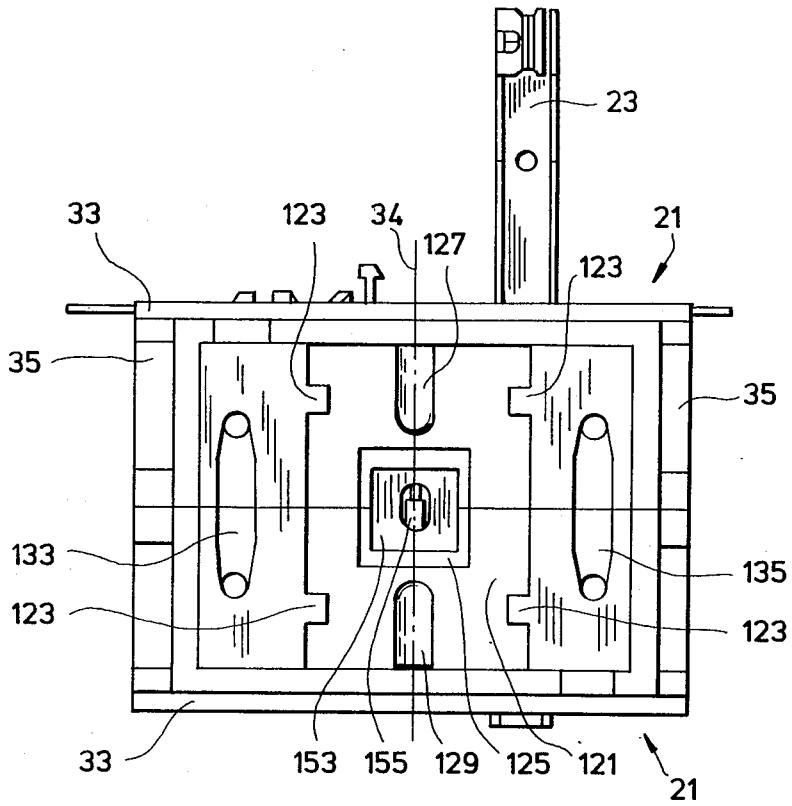
FIG. 4 is an end view of the embodiment of FIG. 2.

The outer side of the bottom wall 33 has been shown horizontally in FIG. 3 and is shaped with transverse grooves 41, 43, and 45, respectively, serving to receive and fix both the fixed contacts and the terminals or external connecting means in the form of for instance short-circuit rails, fuse holders or connecting means (terminal extensions) etc.

The fixed contacts can be interconnected in pairs in a manner known per se by means of the movable contacts, and they comprise short, bent, substantially L-shaped current rails made of lengths of copper having been surface treated in such a manner that the contact resistance between fixed and movable contacts is minimized.

Each groove comprises a ledge 46 in one side in such a manner that it is narrower at the bottom than at the top. The narrow portion is of a depth corresponding to the thickness of the L-shaped current rail lengths, and it serves to receive and fix the fixed contacts, whereas the broad portion of the grooves serves to receive and fix said external connecting means (terminals).

At the bottom of each groove 41, 43, and 45 elongated holes 47 and 49 are provided mirror-symmetrically about the central plane 34. These holes serve to receive one leg of the L-shaped fixed contacts. Furthermore, a rectangular opening 50 is recessed in each end of the grooves and serve to receive plate-shaped nut members 51 and 53, respectively.

The nut members are provided with threaded holes 55 and are secured by screws from the inside by means of machine screws 57, cf. the dotted line in FIG. 1. Each nut member 51 and 53 is furthermore provided with an additional threaded mounting hole 59 for fastening by screws both of the fixed contacts and of the external connecting means as mentioned above.

The mounting of the rectangular nut members in the bottom of the grooves and the fastening thereof from the inside ensure a reliable securing of the nut members in such a manner that in connection with the subsequent mounting and demounting of both the fixed contacts and the external connecting means it is ensured that these members are not disengaged unintentionally.

The above embodiment ensures furthermore that the fixed contacts can be mounted together with the external connecting means on the switch housing by means of the same bolt and in the same operation. The latter provides essential cuts of the working hour and ensures an intimate contact between the articles in question not only at the time of the mounting but also during the entire lifetime of the switch housing in question.

In the finally assembled switch the top and bottom members are kept together by means of six bolts 61 with associated nuts, said bolts extending through suitable bolt holes 63 in the walls of the halves 21.

Figure 5:
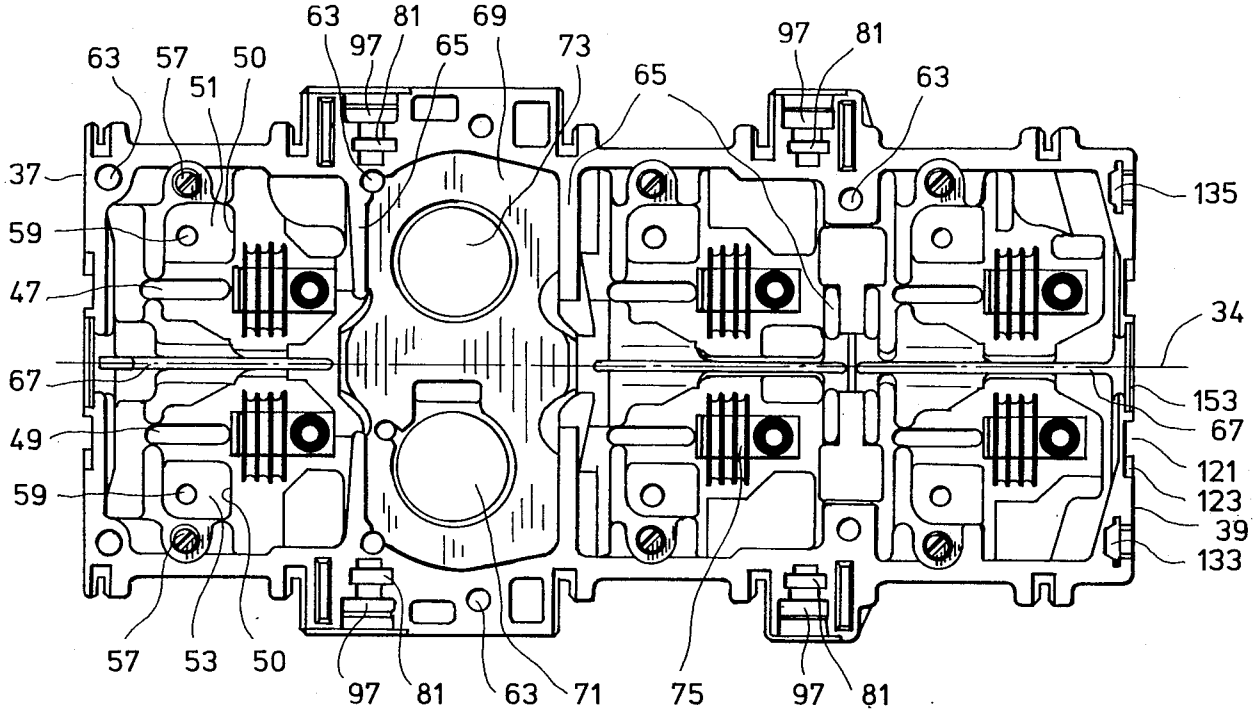
FIG. 5 is a horizontal view of the interior of one half of the switch housing according to the invention.

FIG. 5 is a horizontal view of the inner side of one half 21. The breaking locations are mutually isolated in a manner known per se by means of partitions 65 in the transverse direction of the switch housing as well as by means of a longitudinal partition 67 in the middle, the latter partition not extending through the chamber 69 including the guiding mechanism of the contact bridge. The longitudinal partition 67 serves furthermore as guide rail for the contact bridge not shown. The bearing openings of the above mechanism have been designated 71 and 73. Finally an arc extinguisher 75 appears opposite each breaking location, said spark arrester extinguisher extinguishing the arc inevitably arising when a heavy current is interrupted.

Figure 2:
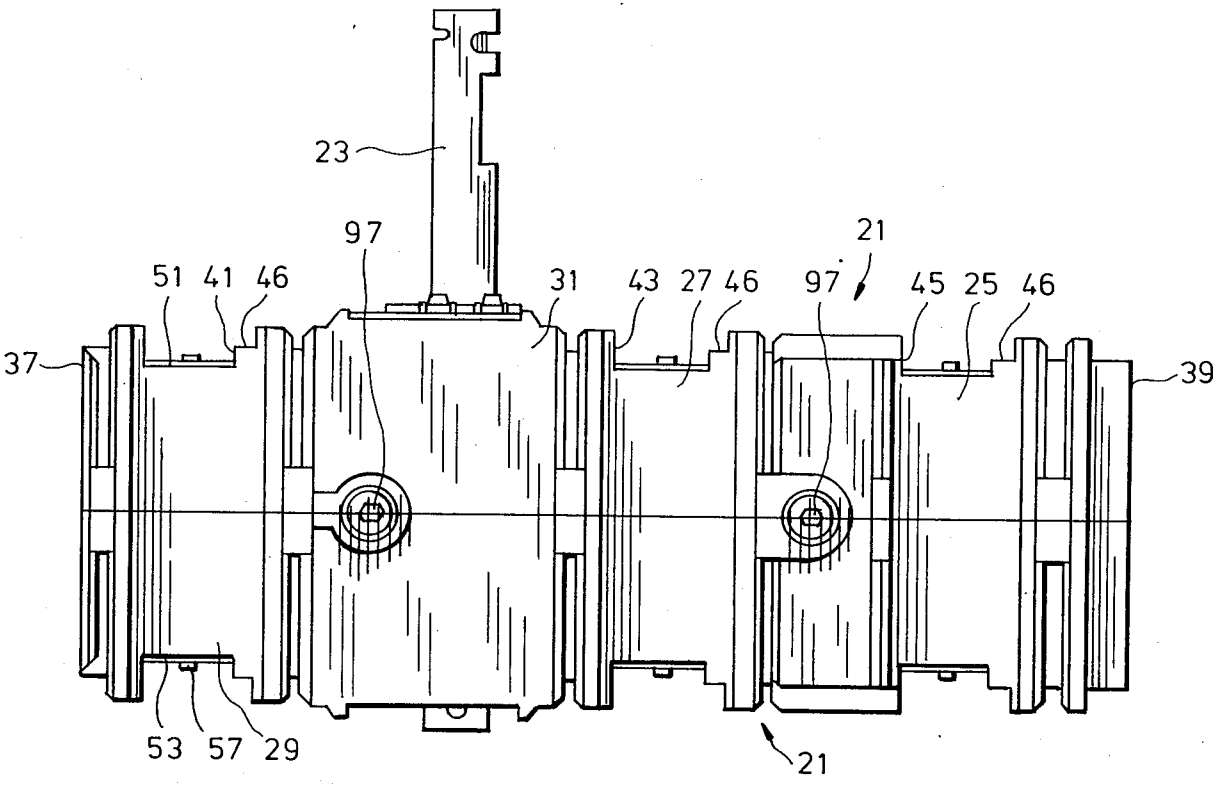
FIG. 2 is a vertical, side view of the switch housing with an assembled top and bottom member.

It appears especially from FIGS. 2 and 3 that the switch housing according to the invention presents a high degree of symmetry. It appears furthermore in detail that the top member and bottom member of the switch housing are completely identical as well as that all the twelve fixed contact means of the switch are identical and are mounted on the outside of the housing on both sides optionally in the form of connecting terminals. These features allow a combination of various systems and structures and present some economical advantages not existing in connection with know switches of the type dealt with.

By using the above switch housing as a basic unit or basis it is now possible by mounting various copper parts thereon to provide the exact type of switch needed in each case and to choose which side is to serve as input or output side. The possibilities of the above should be seen in the light of the circumstance that such a mounting does not interfere with the vital (internal) members of the switch. The breaking locations remain untouched, and the latter also applies to the contact bridge as well as to the guiding mechanism thereof and an optionally built-in automatic release mechanism. The various mounting procedures are illustrated below by way of some examples.

Figure 6:
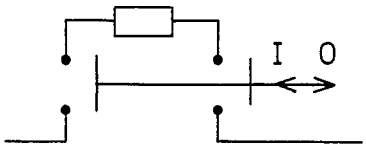
FIG. 6 illustrates the wiring diagram of a single phase of a fuse switch.

FIG. 6 illustrates the wiring diagram of a switch with a fuse, viz. a so-called fuse switch. The Figure deals only with a single phase and is self-explanatory. The advantageous feature is here that a BS-standard is met by mounting one type of fuse holders and a DIN-standard is met by mounting another type of fuse holders.

Figure 7:
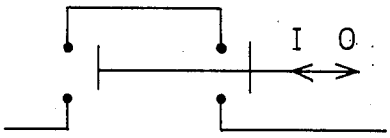
FIG. 7 illustrates a corresponding wiring diagram of a quick switch.

The limiting features of a switch are partly its breaking capacity, i.e. its capacity or possibility of interrupting various types of currents, (said type of current being determined by cos $\phi$, whereby $\phi$ is the phase shift between an alternating current and voltage) partly the thermal conditions (according to some standard defining how warm the terminals of a switch is allowed to become). As far as the fuse switch is concerned it is not the breaking capacity but the thermal conditions that constitute the limiting factor as the fuse is the component generating most of the heat in the switch. This problem can be solved by replacing the fuse by a short-circuit rail as indicated in FIG. 7 and by positioning the fuse somewhere else. This type of switch allows a higher current because the problem of heat generation in the fuse has been removed therefrom. In this manner the breaking capacity of the switch can be completely utilized.

It is also possible to mount a short-circuit rail or bar both on the top and on the bottom member and thereby to position the interrupting locations in parallel, cf.

Figure 8:
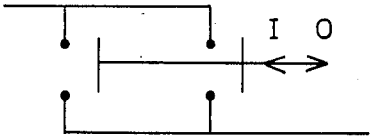
FIG. 8 illustrates a corresponding wiring diagram of a parallel switch.

FIG. 8, and distribute the load on two interrupting locations. In this manner a thermal problem is overcome, but at the expense of the breaking capacity.

Based on a single basic unit and some short-circuit rails it is thus possible to connect the breaking locations in series or in parallel and thereby to adapt the switch to various conditions.

Figure 9:
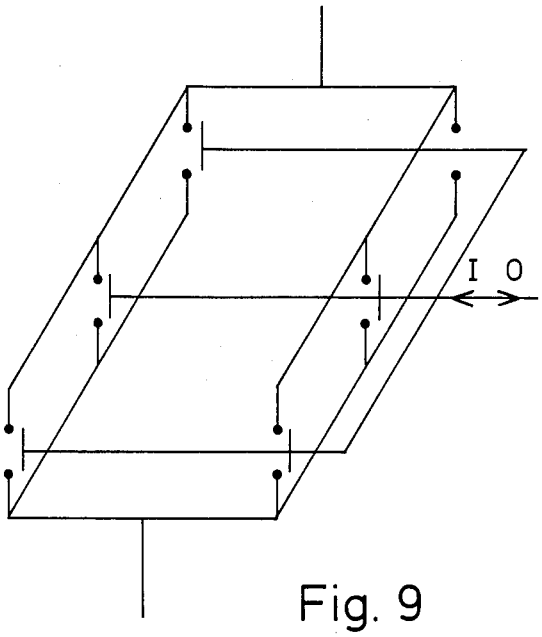
FIG. 9 illustrates a wiring diagram of a parallel switch corresponding to a 1-pole construction of a switch according to the invention.

The parallel coupling of the breaking locations can be developed so far by means of the switching housing according to the invention that all six contact systems are coupled in parallel, cf. FIG. 9. In this manner a one-pole version appears which in turn can be coupled into each phase.

Finally by means of a particular bending of the terminal connections it is furthermore possible to establish a side connection of the switch housing in the cases with little room. An example thereof appears from FIG. 10 at the reference numerals 77, 78, and 79, respectively.

The economical consequence of this system is that switchboard constructors need not as previously hold a great stock of each type of completely mounted switches. Now a lower number of basic units of the above type of switch housing according to the invention as well as a suitable selection of fuse holders, short-circuit rails etc. not involving much capital suffize, said unit being far the expensiest component. In other words the stock can be kept at a far lower level than it was possible previously.

Furthermore if a short-circuit rail or external connecting means is lacking the electrician or switchboard constructor can himself make the lacking short-circuit rail or connecting means based on the guidelines provided by the switch manufacturer for mounting on the switch housing where necessary.

Compared to known types of switches the switch housing according to the invention is furthermore distinguished by the possibility of choosing the input/output side in response to the most advantageous side on the location in question because the top and bottom member are identical. The switch housing according to the invention allows a free choice.

Beyond the possibility of a greater flexibility as to the purpose the switch is to serve in electric respect, the switch housing according to the invention has furthermore been structured in view of the flexibility concerning the purely mechanical mounting.

Figure 10:
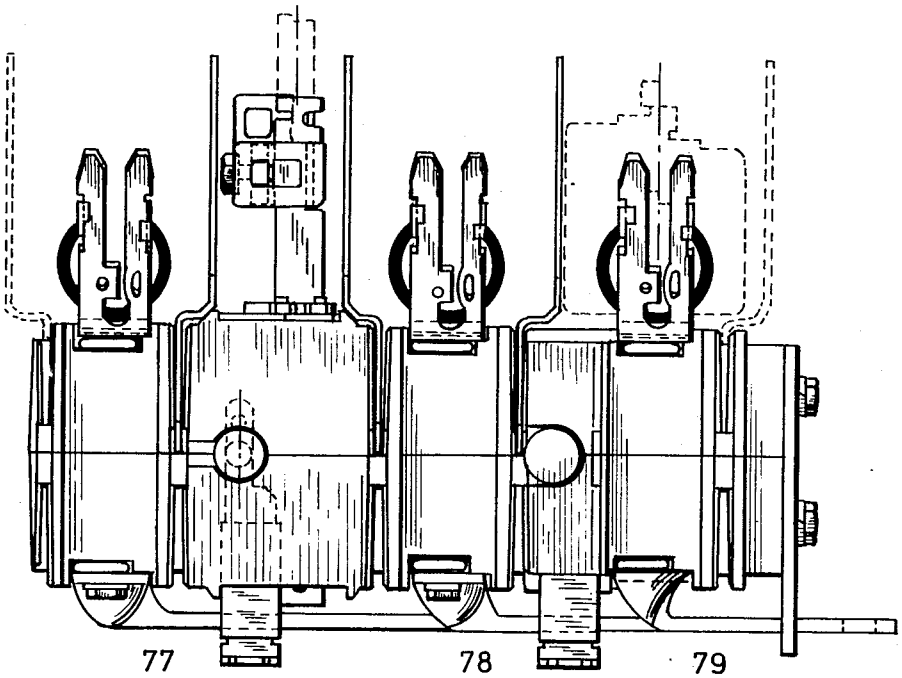
FIG. 10 is a vertical, side view of an example of side connection of the switch housing.
Figure 11:
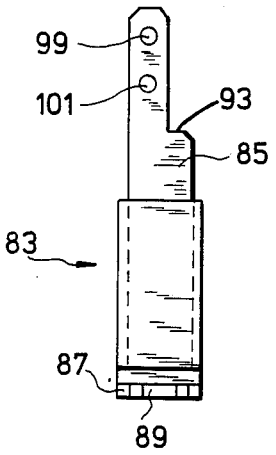
FIG. 11 is a side view of an L-shaped mounting member.
Figure 12:
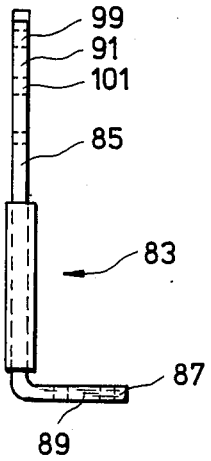
FIG. 12 is a front view of the mounting member of FIG. 11.

In the side walls 35 (FIG. 4) each half 21 of the housing is provided with channels holes or ducts 81 allowing insertion of a mounting member such as for instance the type shown in FIGS. 11 and 12. The mounting member is designated 83 and comprises a substantially L-shaped metal member, the long leg 85 of which is to be inserted in said channels holes or ducts, and the short leg 87 of which is to be secured on a frame, a bracket or the like support. The short leg 87 of the mounting member is provided with a screw hole 89 whereas its long leg 85 is made narrower in the outermost portion 91 and thereby produces a shoulder 93. The channels holes or ducts are correspondingly narrowed at the bottom while forming a ledge 95, cf. FIG. 3, in such a manner that the inserting depth of the mounting members 83 is limited. In the middle the chanels holes or ducts 81 are furthermore provided with a hole 97 accessible from the outside and through which a screw can enter the channel holes or ducts so as therein to be screwed into a threaded hole 99 in the narrow portion 91 of the mounting member. This narrow portion may even comprise several threaded holes for the mounting of the switch housing at various heights above the support. An additional threaded hole 101 appears from the drawing also as shown in FIG. 10.

Figure 13:
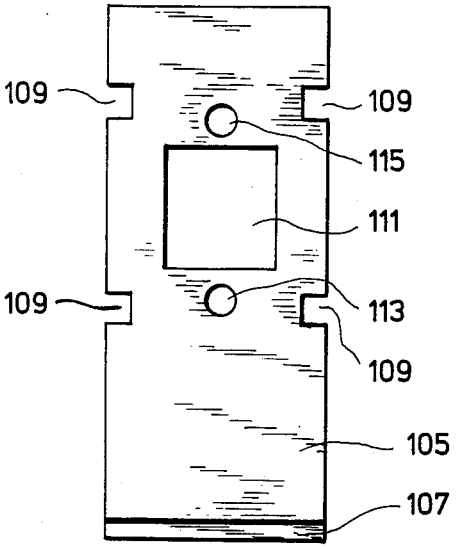
FIG. 13 is a front view of an end wall mounting.
Figure 14:
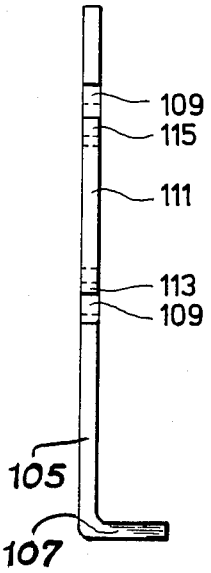
FIG. 14 is a side view of the end wall mounting of FIG. 13.

The switch housing according to the invention allows furthermore a mounting by means of mounting fittings secured on the end walls 37 and 39 of the housing. A possible embodiment of the mounting fittings appears from FIGS. 13 and 14. The mounting comprises a flat, rectangular piece of metal sheet 105 bent at one end in an angle to form a gripping edge 107. Four rectangular notches 109 are provided in the long sides of the sheet 105 two in each side. A rectangular opening 111 is provided in the center between the four notches 109. The presence of the opening 111 will be explained below. Bolt holes 113 and 115, are provided above and below the window opening for the mounting of the fittings with a bolt and nut.

Both end walls 37 and 39 of the switch housing are provided with recessed area 121 arranged to receive mounting fittings 105 and comprising projections 123 along the sides corresponding to the notches 109 of the mounting fittings 105 as well as a flange 125 in the middle corresponding to the opening 111 of said fittings. The depth of this area 121 corresponds to the thickness of the mounting fittings 105. At the top and the bottom of the recessed area a T-formed groove 127 and 129, respectively, for a bolt head 131, cf. FIG. 3, are provided for the securing of the mounting fittings. The mounting of the fittings is initiated by the bolts 131 in question being inserted in the grooves 127 mounted, the bolt stems protruding through bolt holes 113 and 115 and 129 whereafter the fittings 105 . Finally two nuts are tightened on the two bolts. This procedure allows four ways of mounting as the portion including the gripping edge 107 can face the same side as the handle shaft 23 or the other side, and finally the gripping edge 107 can in each of these positions turn over or face the housing or face backward away from the housing. Also in the latter case mounting fittings can be provided of varying lengths in such a manner that the switch housing can be mounted at varying distances from the support.

The end wall 39 farthest from the section 31 for the guiding mechanism is furthermore provided with with other bolt head grooves 133 and 135 for the mounting of an extra unit comprising a single set of contacts for closing and opening for instance the neutral wire of a three-phase system.

Figure 15:
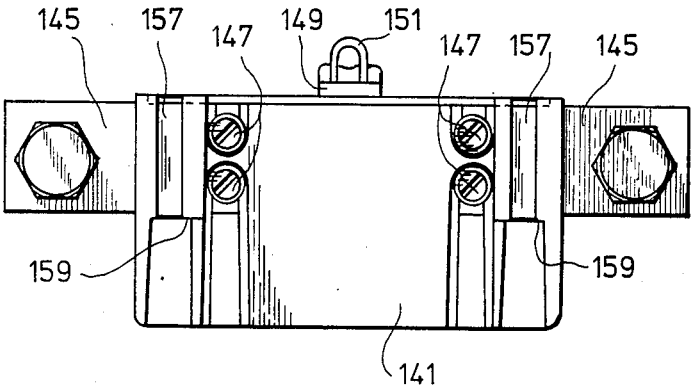
FIG. 15 is a side view of an auxiliary switch housing for the end wall mounting.
Figure 16:
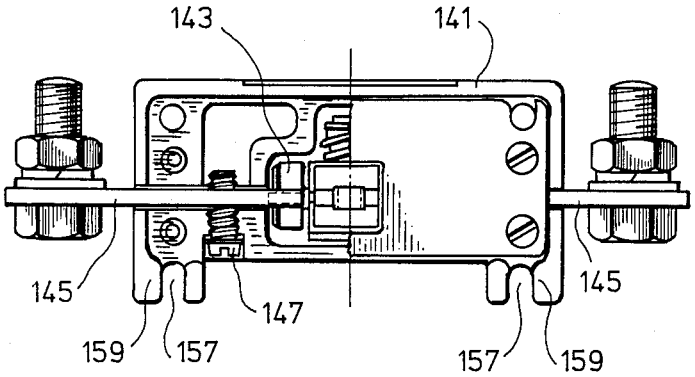
FIG. 16 is a top view of the switch housing of FIG. 15.

As shown in FIGS. 15 and 16 the extra unit comprises a small housing 141 including a single set of movable contacts 143. The embodiment of these movable contacts is well-known and therefore only indicated by a dotted line in the drawing. The fixed contacts or terminals 145 extend through the sides of the housing 141 and are retained by means of screws 147 as illustrated. The movable contacts are placed on a contact holder 149 provided with a clevis 151 projecting slightly beyond the housing 141. This clevis may extend through a window 153 in the end wall 39 farthest from the guiding mechanism of the contact bridge and there be secured on a hook 155 situated at the end of the contact bridge. Subsequently the unit is secured by means of bolts, the heads of which extend into the grooves 133 and 135. The housing 141 is provided with half-open screw holes 157 in which the bolts may fit and be tightened by means of nuts abutting suitable knobs 159 at the end of the screw holes.

What is claimed is:

1. A housing having a hollow interior for receiving a complete switching mechanism for a multipole power switch of the kind including a reciprocative contact bridge supporting a plurality of movable contacts for short circuiting pairs of corresponding L-formed fixed contacts, said housing comprising two identical halves forming a bottom member and a top member and having a longitudinal dimension and a transverse dimension, the bottom member having a bottom wall and the top member having a top wall, each member also having two symmetrical end walls and two mutually symmetrical side walls, wherein the outer surface of said bottom wall and said top wall are provided with transverse grooves for receiving mounting ends of the L-formed fixed contact members and external terminals, said transverse grooves being provided with elongated holes for receiving contact ends of the L-formed fixed contact members, and wherein plate-shaped nut members are secured from the inside of the housing in each end of said transverse grooves, said nut members being provided with threaded holes for receiving screws for fastening the mounting ends of L-formed fixed contacts and external terminals in one operation.

2. A switch housing as in claim 1 including ducts provided in the side walls, said ducts receiving mounting members for maintaining the housing on a support, and holes provided in the side walls, said holes extending into said ducts and adapted to receive screws for securing said mounting members in said ducts.

3. A switch housing as in claim 2 wherein the ducts are narrowed at the bottom while forming a ledge for limiting the insertion depth of the mounting members.

4. A switch housing as in claim 1 wherein opening is provided in the bottom of the grooves in each end for receiving and exposing the nut members.

5. A switch housing as in claim 1 wherein a recessed area is provided in the end walls, said area comprising projections along the sides for the securing of complementarily shaped end wall fittings for mounting the housing with an end wall facing a support, said area also comprising at least two grooves each groove being arranged to receive a bolt head of a bolt for securing said end wall fitting to the housing.

6. A switch housing as in claim 1 wherein the end walls are provided with an opening aligned with the ends of the contact bridge in order to allow a securing onto the contract bridge of an additional switch unit comprising a set of fixed contacts and a set of movable contacts co-operating with said fixed contacts, the end walls furthermore being provided with at least two grooves allowing the mounting of an additional switch unit on the end wall.

* * * * *